US007321276B2

(12) United States Patent
Nichols

(10) Patent No.: US 7,321,276 B2
(45) Date of Patent: Jan. 22, 2008

(54) INDEPENDENTLY ADJUSTABLE COMBINED HARMONIC REJECTION FILTER AND POWER SAMPLER

(75) Inventor: Todd Wayne Nichols, Cary, NC (US)

(73) Assignee: Harris Stratex Networks, Inc., Morrisville, NC (US)

( * ) Notice: Subject to any disclaimer, the term of this patent is extended or adjusted under 35 U.S.C. 154(b) by 235 days.

(21) Appl. No.: 11/169,879

(22) Filed: Jun. 30, 2005

(65) Prior Publication Data

US 2007/0001780 A1 Jan. 4, 2007

(51) Int. Cl.
*H01P 5/12* (2006.01)
*H01P 5/18* (2006.01)

(52) U.S. Cl. ..... 333/109; 333/110; 333/116

(58) Field of Classification Search ..... 333/109, 333/110, 111, 112, 116, 205
See application file for complete search history.

(56) References Cited

U.S. PATENT DOCUMENTS

| | | | |
|---|---|---|---|
| 4,216,446 | A | 8/1980 | Iwer |
| 4,536,725 | A | 8/1985 | Hubler |
| 4,714,903 | A | 12/1987 | Brand |
| 4,999,593 | A | 3/1991 | Anderson |
| 5,023,866 | A | 6/1991 | De Muro |
| 5,159,298 | A | 10/1992 | Dydyk |
| 5,212,815 | A | 5/1993 | Schumacher |
| 5,230,093 | A | 7/1993 | Rich et al. |
| 5,243,305 | A | 9/1993 | D'Oro et al. |
| 5,382,925 | A | 1/1995 | Hayashi et al. |
| 5,499,001 | A | 3/1996 | Degun et al. |
| 6,046,654 | A | 4/2000 | Jamal et al. |
| 6,150,898 | A | 11/2000 | Kushitani et al. |
| 6,549,089 | B2 | 4/2003 | Ashoka |
| 6,608,538 | B2 | 8/2003 | Wang |
| 6,781,476 | B2 | 8/2004 | Tsunoda et al. |
| 6,784,766 | B2 * | 8/2004 | Allison et al. ..... 333/205 |
| 6,794,953 | B2 | 9/2004 | Brandt |
| 6,794,954 | B2 | 9/2004 | Gurvich et al. |
| 6,825,738 | B2 | 11/2004 | Shumovich |
| 2005/0104681 | A1 | 5/2005 | Allen et al. |

OTHER PUBLICATIONS

Power Dividers and Directional Couplers; 7 pages; https://ewhdbks.mugu.navy.mil/couplers.htm; downloaded Jun. 24, 2005.

* cited by examiner

*Primary Examiner*—Dean Takaoka
(74) *Attorney, Agent, or Firm*—Marc A. Sockol; Thelen Reid Brown Raysman & Steiner LLP

(57) ABSTRACT

An adjustable low pass filter and directional coupler used in microwave communication are combined to reduce the size of the microwave circuit. The low pass filter portion and coupling portion are made independently tunable with a plurality of varactors and variable reactance circuits connected to ground.

16 Claims, 5 Drawing Sheets

INDEPENDENTLY ADJUSTABLE COMBINED HARMONIC REJECTION FILTER AND POWER SAMPLER

BACKGROUND

The demand for smaller and lower cost components for consumer electronics has increasingly led to efforts to reduce the sizes of various microwave components. An example of such a component is a microwave directional coupler utilized in wireless terminals for monitoring transmitted power. In such applications, size and weight may be critical parameters.

A conventional microwave directional coupler utilizes two 50 ohm transmission lines, each having an electrical length of one quarter wavelength at the operating frequency. The spacing between the transmission lines is selected to provide the desired electromagnetic coupling. At an operating frequency of 1.95 GHz, the length of a conventional microstrip directional coupler is 19 millimeters (mm). This dimension is large in proportion to the overall package size of typical wireless terminals.

A directional coupler is a passive device which couples part of the transmission power by a known amount out through another port, often by using two transmission lines set close enough together such that energy passing through one is coupled to the other. The term "main line" refers to the main transmission line. On some directional couplers, the main line is designed for high power operation (large connectors), while the coupled port may use a small SMA (SubMiniature version A) connector. Usually the isolated port is terminated with an internal or external matched load (typically 50 ohms).

Physical considerations such as an internal load on the isolated port will limit port operation. The coupled output from the directional coupler can be used to obtain the information (i.e., frequency and power level) on the signal without interrupting the main power flow in the system. It should be recognized that the coupled response is periodic with frequency. For example, a ¼ coupled line coupler will have responses at n/4 where n is an odd integer.

Common properties desired for all directional couplers are wide operational bandwidth, high directivity, and a good impedance match at all ports when the other ports are terminated in matched loads.

Microstrip directional couplers having a capacitor or other reactive element connected between the two transmission lines are disclosed in U.S. Pat. Nos. 4,216,446 and 5,159,298. The capacitor or other reactive element is stated to improve the directivity of the directional coupler.

A directional coupler having a capacitor connected between transmission lines and shunt capacitors connected between each transmission line and ground is disclosed in U.S. Pat. No. 5,243,305. The capacitors are connected at the center of the transmission lines and are stated to increase the directivity of the directional coupler.

A capacitively compensated microstrip directional coupler is disclosed in U.S. Pat. No. 4,999,593. Reactive coupling networks are coupled between the transmission lines of the directional coupler at each end. Each reactive coupling network includes a first capacitor coupled between a common node and the first transmission line, a second capacitor coupled between the common node and the second transmission line, and a third capacitor coupled between the common node and ground. This interconnection however eliminates the independence between the transmission lines.

All known prior art microwave directional couplers have had one or more drawbacks, including but not limited to unacceptable physical size and a large number of compensation components. Accordingly, there is a need for improved microwave directional couplers.

Directional couplers as disclosed above are a well known element for radio frequency equipment. The directional coupler (a.k.a. a power sampler) allows a sample of a radio frequency signal, which is input at an input terminal and output at an output terminal, to be extracted from the input signal. Properly designed, the directional coupler can distinguish between a signal input at the input terminal and a signal input at the output terminal. This characteristic is of particular use in a radio frequency transmitter in which both the input signal and a signal which is reflected from a mismatched antenna can be independently monitored. One or the other or both of these signals can be utilized in a power control circuit to control the output power of the transmitter.

Another element well known in the output circuit of a transmitter is a harmonic filter, which is employed to reduce the energy coupled to an antenna at harmonic frequencies of the desired output signal. In a system which consists of a transmitter coupled to an antenna, the harmonic filter can be a relatively simple low pass filter. In a system where the transmitter must share the same antenna with other equipment, e.g., a companion receiver, the harmonic filter may take on a somewhat more complex configuration. For example, a bandpass filter which passes only a relatively narrow band of frequencies at which the transmitter is designed to operate while rejecting all other frequencies has been used in critical applications such as cellular radiotelephones. In order to achieve the lowest insertion loss within the smallest practical size, frequency resonant structures such as helical or coaxial resonators have been the choice of radio equipment designers. Unfortunately, resonant structures experience a reduction in their attenuation characteristics at frequencies which are approximately odd order harmonics of the passband frequency. Such a response is known as flyback. In order to overcome the flyback response, equipment designers have placed additional filtering in series with the resonant structure bandpass filter. One example of this additional filtering may be found in U.S. Pat. No. 5,023,866.

A radio equipment designer wishing to design high performance radio equipment may elect to employ a directional coupler, a resonant structure bandpass filter and an odd order harmonic flyback filter, but heretofore, has been constrained to use conventionally realized individual circuit elements. Such a configuration, with individual circuit elements, can experience potentially higher failure rates and dramatically increased size and cost of equipment.

Other prior art solutions lack the versatility desired by radio equipment designers and operators.

As illustrated in FIG. 1, the prior art of U.S. Pat. No. 5,212,815 discloses a transceiver utilizing a directional coupler. The radio transmitter 101, of conventional design for radio telephone use, is coupled to the input of directional coupler 103, the output of which is coupled to a conventional isolator 105. The isolator 105 reduces the amount of reflected power conveyed back to the transmitter 101 caused by impedance mismatches in bandpass filter 107 or the antenna 109. The directional coupler 103 provides a sample of the transmitter output signal which is attenuated and coupled from a forward power port to a power control circuit 115. However, the directional coupler 103 is not tunable, nor can the operation of the power sampler be decoupled from the operation of the stubs. Thus, attributes of the coupler and filter cannot be independently achieved.

As illustrated in FIG. 2, the prior art of U.S. Pat. No. 6,150,898 discloses an integrated component providing the function of both a conventional directional coupler 201 and a low-pass filter 202 having two attenuation poles 208 and 209 at a specified frequency band without changing the line length. Stub lines are connected to both ends of a main transmission line 205 of a directional coupler and the frequency of the attenuation poles is determined by fixed characteristics including impedance, terminating conditions and line length of the stub line. However, the prior art integrated component is a low pass filter and not a band reject filter and additionally, the lengths and impedance of the integrated components are not adjustable, i.e., they are manufactured for a set frequency and thus are not readily adaptable to allow for independent tuning of the coupler and filtering functions.

In view of the deficiencies of the prior art, it is an object of the present subject matter to obviate these deficiencies by presenting an independently tunable, combined coupler and filter.

These and many other objects and advantages of the present invention will be readily apparent to one skilled in the art to which the invention pertains from a perusal of the claims, the appended drawings, and the following detailed description of the preferred embodiments.

DETAILED DESCRIPTION

The present subject matter is advantageously used in modules in which functions are incorporated sequentially; that is, in a line, one after another. The sequential arrangement of these functions consumes much physical room in the module. These microwave modules tend to be long and narrow, and there is often not enough room for multiple functions in a linear row. This present subject matter combines two functions-filtering and coupling (power sampling) which are usually done sequentially, into one structure along with the ability to independently tune the coupler and the filter. Therefore, less room is required, especially along the length of the module.

Additionally, the filter and coupler of the present subject matter are tunable based on frequency, insertion loss, coupling factor and/or return loss, not just frequency.

Microwave power amplifiers often have a harmonic filter followed by a coupler for power sampling on the output. In modules, multiple functions are generally realized sequentially. The present subject matter by combining two functions into one, minimizes the physical room required, and the module can be made shorter with the same functionality. Also the combined functionality provides for improved specifications over either function alone; i.e., it can be considered a sampling power detector which also reduces harmonic content or a harmonic filter which also provides for power sampling.

The present subject matter works by realizing a low pass harmonic stub-type filter. Power sampling couplers are usually at least 10 dB down from the sampled signal, and sampling this level of power from the filter structure interacts with the filter minimally. The coupled line section is placed on the side of the filter opposite to that of the stubs, such that it does not load or otherwise interfere with the filter substantially.

Figure 3:
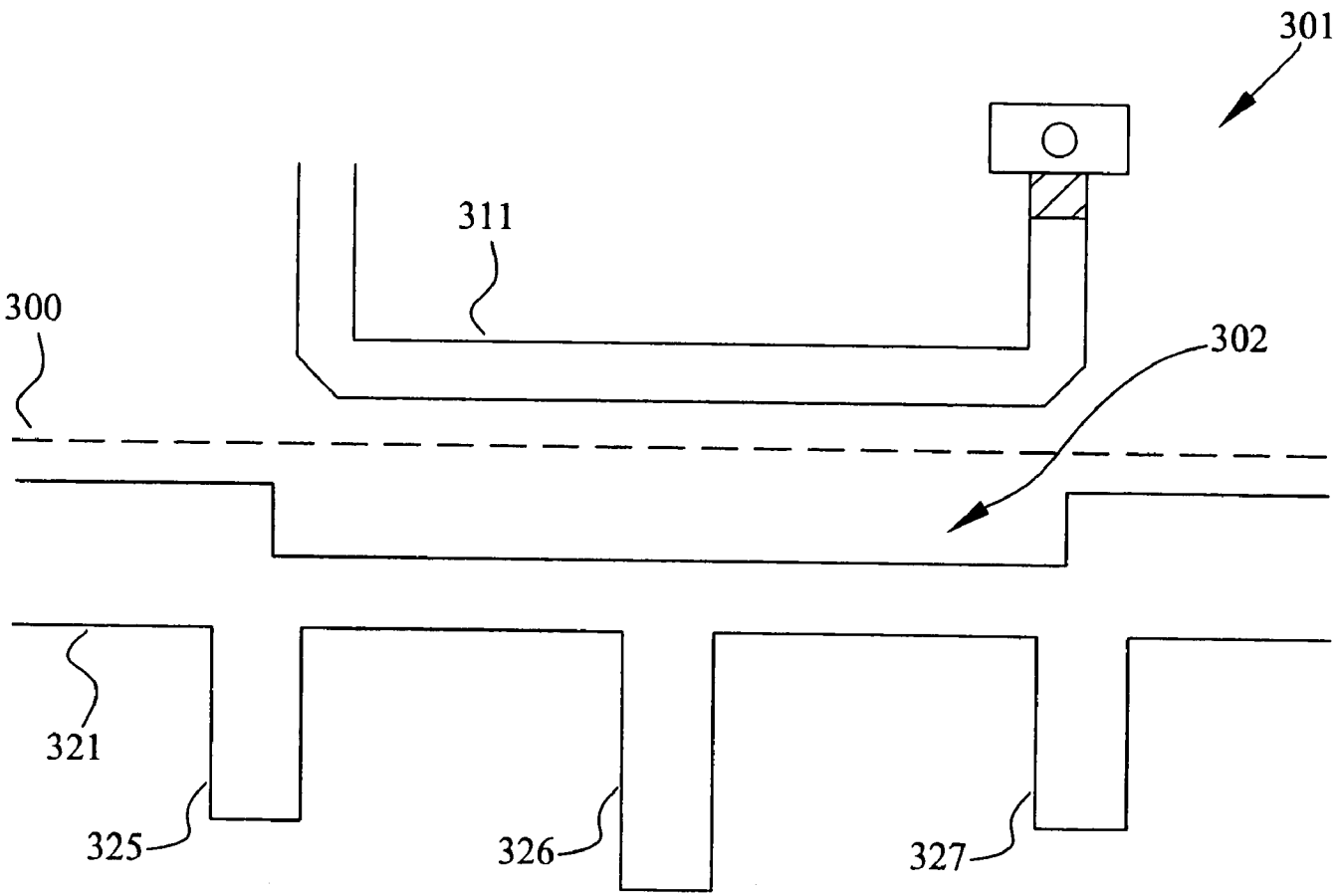
FIG. 3 is a representation of a directional coupler according to an embodiment of the present subject matter.

FIG. 3 is a representation of a combined filter and directional coupler according to an embodiment of the present subject matter. A first transmission line 321 with a plurality of stubs 325, 326 and 327 make up the low pass or harmonic filter 302. In FIG. 3 a trombone filter is shown but other and different combinations of stubs are also envisioned. In the prior art, the length of the stubs is dictated by frequency only, however in the present subject matter, the length of the stubs is predicated on frequency, insertion loss and return loss, which leads to stub length and/or spacing deviations from the standard $\lambda/4$. Additionally each stub may advantageously be independently sized.

The directional coupling or power sampling portion 311 of the combined directional coupler and filter has an output end and a terminal end. The power sampling portion 311 is substantially parallel to and laterally spaced with the filter portion 302. The coupling portion 301 is in electromagnetic connection with the filter portion 302 as necessary to extract a portion of the signal. The sampling portion 311 is located opposite the stubs of the filter, as shown in FIG. 3 to avoid interference between the coupler portion 301 and the filter portion 302. However, other parallel configurations that minimize deleterious interference are also envisioned.

Figure 4:
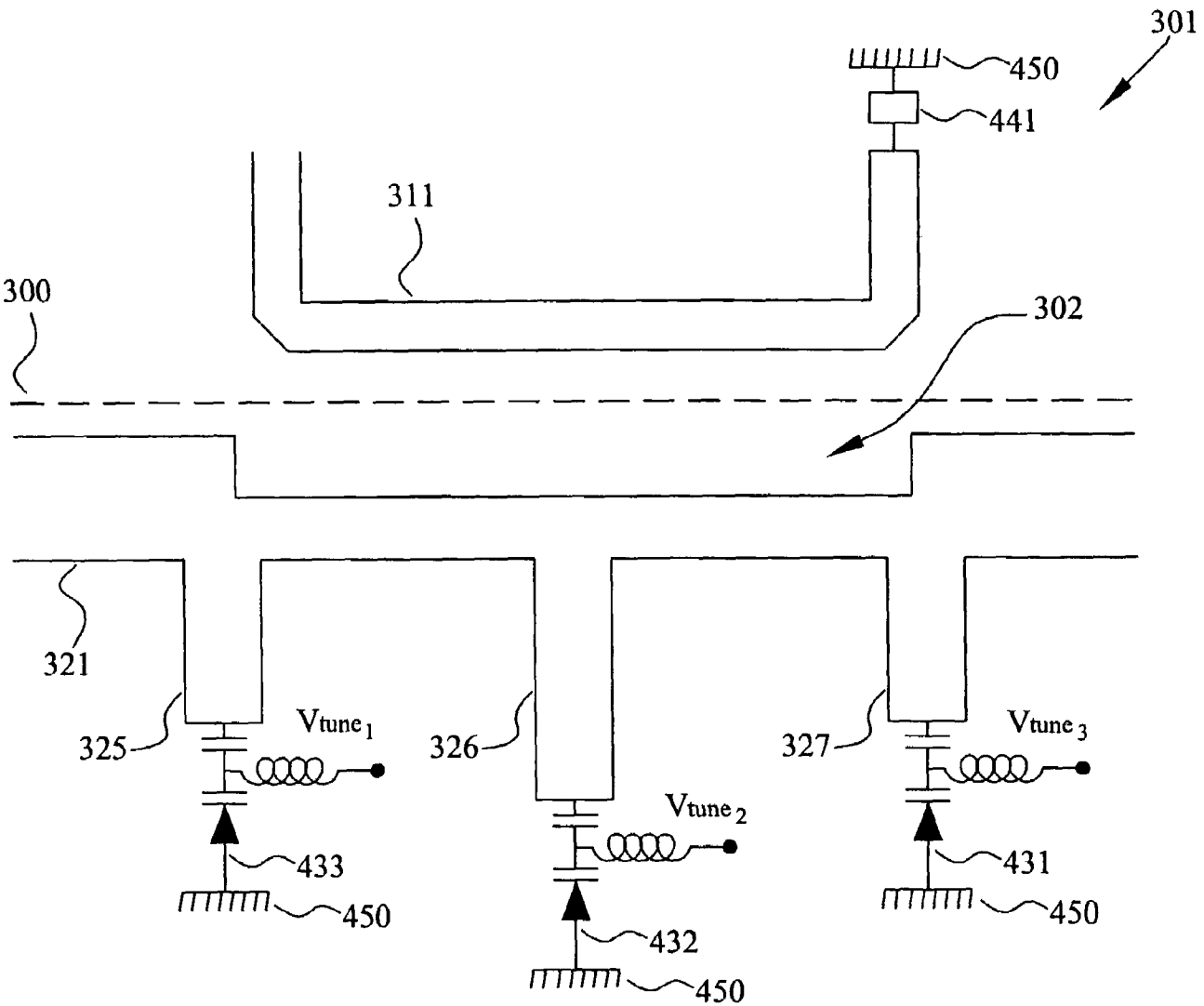
FIG. 4 is a representation of a directional coupler according to an embodiment of the present subject matter.

FIG. 4 is a representation of another combined filter and directional coupler according to an embodiment of the present subject matter which allows independent adjustment to the coupler portion 301 and the filter portion 302. As shown in FIG. 4, variable capacitors or varactors 431-433 are connected between the end of one or more stubs 325-327 and ground 450. FIG. 4 also shows electronic components required to isolate and bias the varactors (e.g. capacitors and inductors). The varacators on FIG. 4 are tuned with $V_{tune1}$-$V_{tune3}$ respectively. As a result the filter can be independently tuned and thus can be optimized during installation to reflect the actual operating environment.

Additionally, a variable adjustable reactance circuit 441 may be placed on the terminal end of the sampling portion 301 and connected to ground 450. The adjustable reactance circuit 441 may include resistors, varactors and other components that allow for changing the terminal impedance of the coupler. This adjustment is independent of the adjustments made to the filter portion 302.

In addition, the combined filter and power sampler can be tuned based upon harmonic rejection, insertion loss, return loss and coupling factor instead of only frequency as shown in the prior art.

Figure 5:
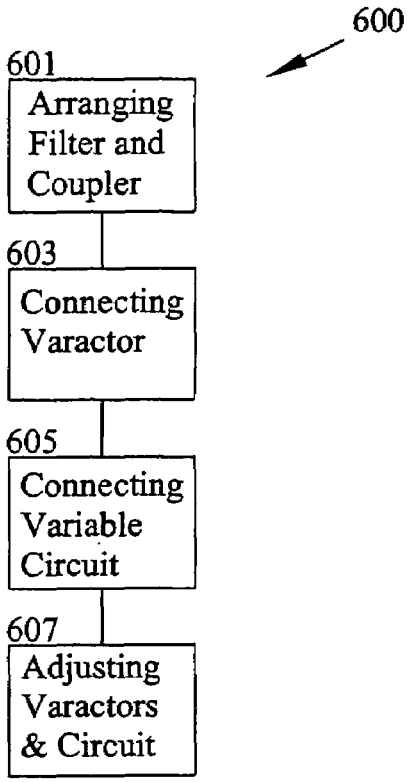
FIG. 5 is a representative flow chart of a method according to an embodiment of the present subject matter.
Figure 1:
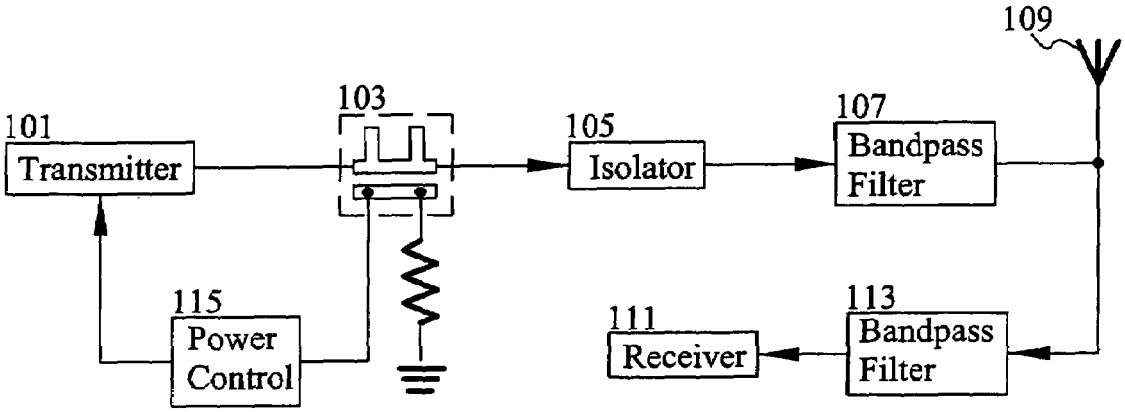
FIGURE 1 PRIOR ART
FIG. 1 is a representation of a prior art directional coupler.
Figure 2:
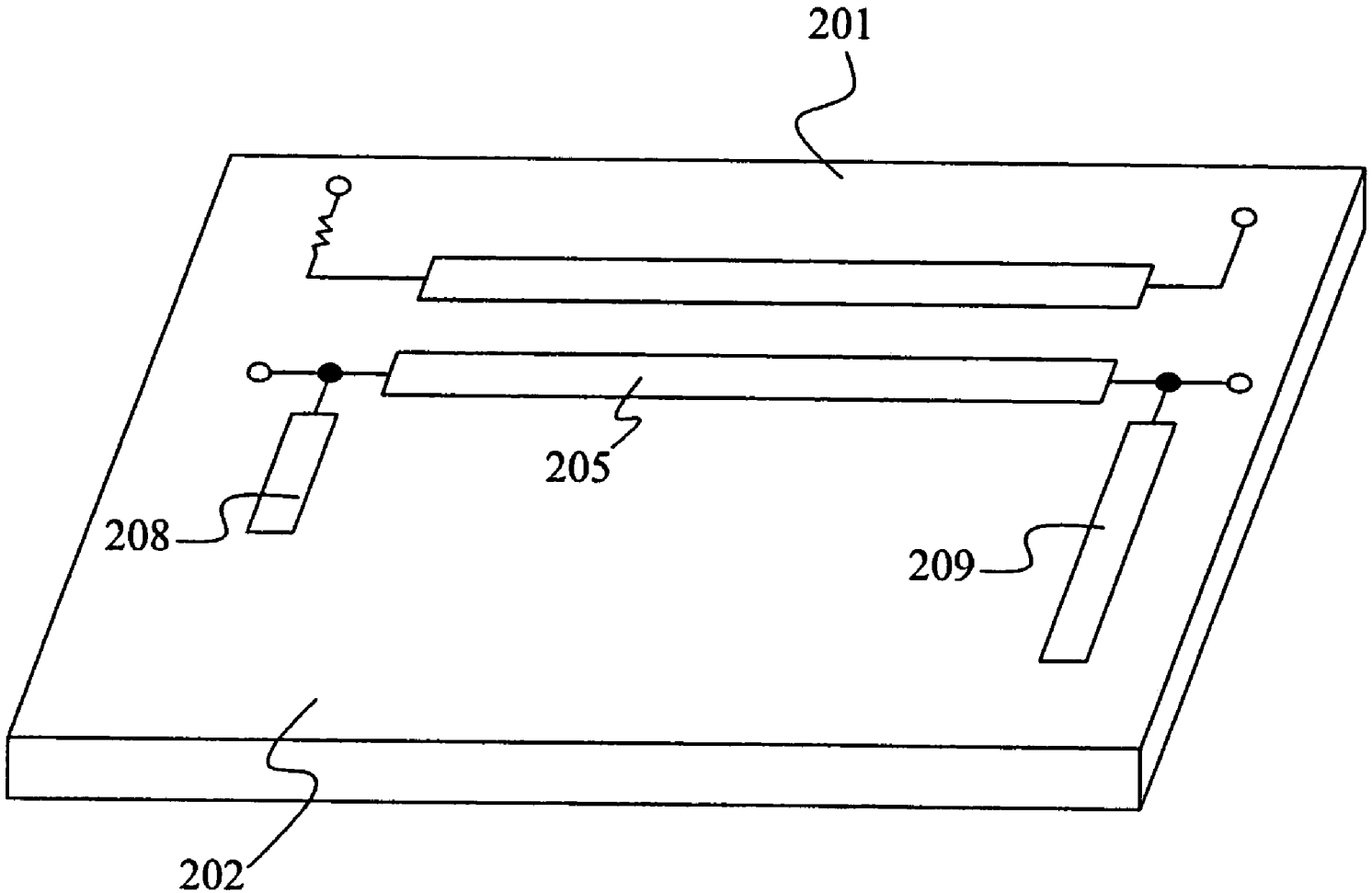
FIGURE 2 PRIOR ART
FIG. 2 is a representation of another prior art directional coupler.

FIG. 5 is a representative flow chart of a method of reducing the length of a microwave circuit according to yet another embodiment of the present subject matter. As shown in block 601 the low pass filter and power sampler are arranged in parallel and laterally spaced apart. The lateral spacing is based on the amount of energy to be sampled from the main stream. As previously discussed the sample is typically around 10 dB or less. Because of the small sample, the directional coupler does not disrupt the operation of the low pass filter.

In block 603, a plurality of varactors are connected between the low pass filter and ground, and in block 605 a variable reactance circuit between the power sampler and ground which serves to terminate one end of the coupler. The varactors associated with the low pass filter base are then adjusted based on harmonic rejection, insertion loss and return loss and the variable reactance circuit of the power sampler is independently adjusted based on desired characteristics such as coupling factor and insertion loss as shown in block 607.

Figure 6:
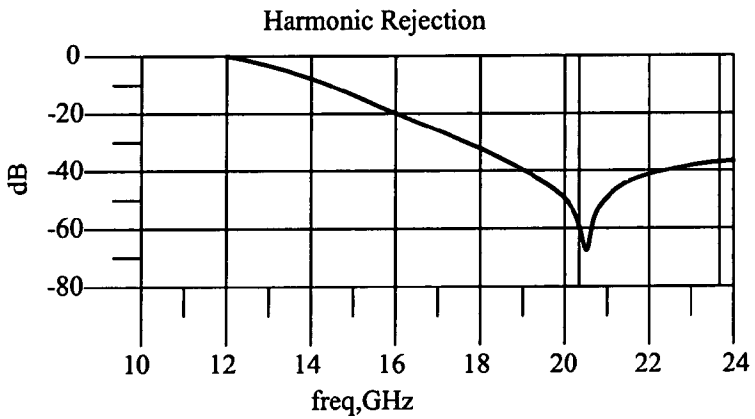
FIG. 6 is a graphical representation of harmonic rejection for an embodiment of the present disclosure.

Harmonic rejection of a representative embodiment of the present subject matter is graphically illustrated in FIG. 6.

Figure 7:
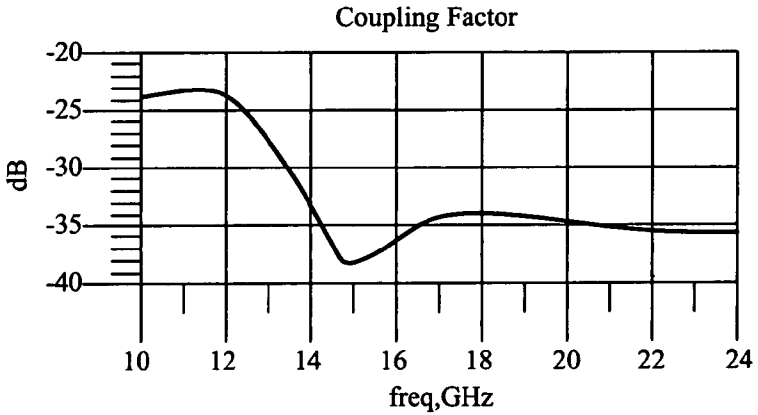
FIG. 7 is a graphical representation of coupling factor for an embodiment of the present disclosure.

FIG. 7 is a graphical representation of the coupling factor for the combined directional coupler and lowpass filter according to an embodiment of the present subject matter. The coupling factor represents the primary property of a directional coupler. Coupling is not constant, but varies with frequency as shown in FIG. 7.

Figure 8:
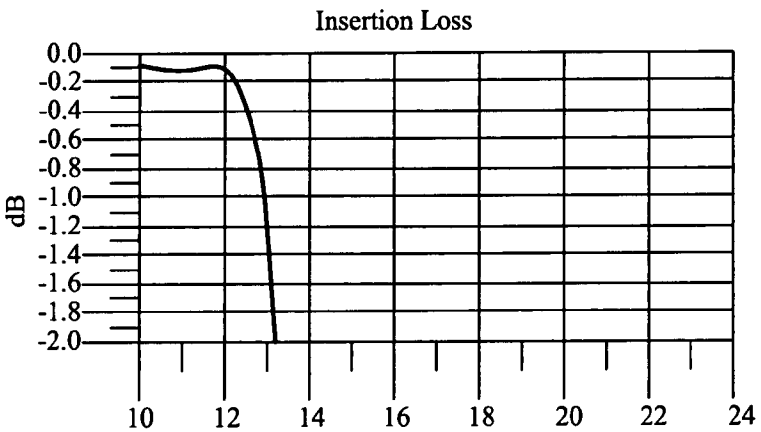
FIG. 8 is a graphical representation of Insertion loss for an embodiment of the present disclosure.

Insertion loss is the loss in signal due to the filter and or coupler existing in the circuit, whereas return loss is the attenuation of a reflected signal in proportion to the forward signal. The insertion loss of an embodiment of the adjustable combined directional coupler and filter are shown in FIG. 8.

Figure 9:
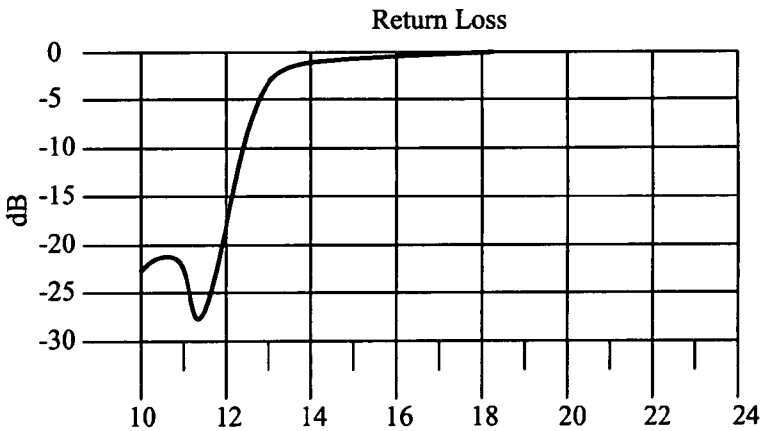
FIG. 9 is a graphical representation of return loss for an embodiment of the present disclosure.

FIG. 9 is a graphical representation of the return loss or an embodiment of the present subject matter. Return loss is a measure of the similarity of the impedance of a transmission line and the impedance at the line's terminations. Return loss is a ratio, expressed in decibels, of the power of the outgoing signal to the power of the signal reflected back.

While preferred embodiments of the-present invention have been described, it is to be understood that the embodiments described are illustrative only and that the scope of the invention is to be defined solely by the appended claims when accorded a full range of equivalence, many variations and modifications naturally occurring to those of skill in the art from a perusal hereof.

I claim:

1. A microwave variable low pass filter with directional coupling comprising:

a main transmission line;

a sub transmission line parallel and laterally spaced of said main transmission line, the sub transmission line in electromagnetic communication with the main transmission line;

one or more stubs operably connected to said main transmission line and opposite the sub transmission line, at least one varactor operable connected between each respective stub and ground; and, an adjustable reactance circuit operably connected between one end of the sub transmission line and ground, wherein the at least one varactor and adjustable reactance circuit are independently adjustable.

2. The low pass filter with directional coupling of claim 1, wherein the at least one varactor and adjustable reactance circuit are adjustable as a function of frequency, insertion loss, coupling factor and return loss desired in the low pass filter.

3. The low pass filter with directional coupling of claim 1, wherein the low pass filter is a band reject filter.

4. The low pass filter with directional coupling of claim 1, comprising three independently tunable stubs operably connected to said main transmission line and opposite the sub transmission line.

5. The low pass filter with directional coupling of claim 1, wherein the main and sub transmission lines have substantially equal lengths.

6. The low pass filter with directional coupling of claim 1, wherein the sub transmission line has a length less than the main transmission line.

7. The low pass filter with directional coupling of claim 1, wherein the main transmission line is a trombone filter.

8. A microwave, directional coupler comprising:

a first transmission line having an input port and an output port;

a second transmission line electromagnetically coupled to parallel with, and laterally spaced from the first transmission line, said second transmission line having a coupled port and a terminated port, said first transmission line comprising at least a low pass filter having two or more stubs, wherein the length of the two or more stubs are a function of frequency, insertion loss, coupling factor and return loss desired in the coupler; and a variable reactance circuit between the terminated port and ground.

9. A microwave directional coupler comprising:

a first transmission line having an input port and an output point;

a second transmission line electromagnetically coupled to, parallel with, and laterally spaced from the first transmission line, said second transmission line having a coupled port and a terminated port, said first transmission line comprising at least a pass filter having two or more stubs, wherein the length of the two or more stubs are a function of frequency, insertion loss, coupling factor and return loss desired in the coupler a plurality of varactors between the two or more stubs and ground.

10. The method of reducing the length of a microwave transceiver having a low pass filter and power sampler in series comprising the steps of arranging the low pass filter and power sampler in parallel and laterally spaced apart;

connecting a plurality of varactors between the low pass filter and ground;

connecting a variable reactance circuit between the power sampler and ground; and, adjusting the plurality of varactors of the low pass filter based on harmonic rejection, insertion loss and return loss and independently adjusting the variable reactance circuit of the power sampler based on coupling factor.

11. A microwave directional coupler comprising:

a first transmission line having an input port and an output port;

a second transmission line electromagnetically coupled to the first transmission line, said second transmission line having a coupled port and a terminated port;

a first varactor coupled between the input port and a reference potential;

a second varactor coupled between the output port and the reference potential; and, a third varactor coupled between the coupled, port and the reference potential, wherein the first, second and third varactors are independently adjustable.

12. The directional coupler of claim 11, wherein at least one of the first, second and third varactors are adjustable as a function of frequency, insertion loss, coupling factor and return loss desired.

13. The directional coupler of claim 11, wherein the first transmission line and first and second varactors from a band reject filter.

14. The directional coupler of claim 11, wherein the first and second transmission lines have substantially equal lengths.

15. The directional coupler of claim 11, wherein the second transmission line has a length less than the first transmission line.

16. The directional coupler of claim 11, wherein the first transmission line is a trombone filter.

* * * * *

UNITED STATES PATENT AND TRADEMARK OFFICE

CERTIFICATE OF CORRECTION

PATENT NO. : 7,321,276 B2
APPLICATION NO. : 11/169879
DATED : January 22, 2008
INVENTOR(S) : Todd Wayne Nichols It is certified that error appears in the above-identified patent and that said Letters Patent is hereby corrected as shown below:

Column 5, line 51 (Claim 1, line 10), following "line" delete "," (the comma) and insert --;-- (a semicolon) therefor.

Column 6, line 10 (Claim 8, line 1), following "microwave" delete "," (the comma).

Column 6, line 13 (Claim 8, line 4), following "coupled to" insert --,-- (a comma).

Column 6, line 26 (Claim 9, line 3), delete "point" and insert --port-- therefor.

Column 6, line 31 (Claim 9, line 8), prior to "pass filter" insert --low--.

Column 6, line 38 (Claim 10, line 1), prior to "method" delete "The" and insert --A-- therefor.

Column 6, line 63 (Claim 11, line 11), following "coupled" delete "," (the comma).

Column 7, line 4 (Claim 13, line 2), delete "from" and insert --form-- therefor.

Signed and Sealed this

Sixth Day of May, 2008

Jon W. Dudas

JON W. DUDAS
*Director of the United States Patent and Trademark Office*